US005122837A

United States Patent [19]

Sonoda et al.

[11] Patent Number: 5,122,837

[45] Date of Patent: Jun. 16, 1992

[54] TONER CARTRIDGE FOR AN IMAGE FORMING APPARATUS

[75] Inventors: Yoshihide Sonoda, Tokyo; Yasuji Takagi, Matsudo; Kouji Ishigaki, Yokohama, all of Japan

[73] Assignee: Ricoh Company, Ltd., Tokyo, Japan

[21] Appl. No.: 568,708

[22] Filed: Aug. 17, 1990

Related U.S. Application Data

[62] Division of Ser. No. 363,766, Jun. 7, 1989, Pat. No. 4,963,938.

[30] Foreign Application Priority Data

Jun. 10, 1988 [JP] Japan ..... 63-77062
Jun. 10, 1988 [JP] Japan ..... 63-077063

[51] Int. Cl.[5] ..... G03G 15/08

[52] U.S. Cl. ..... 355/260; 355/205; 118/653; 222/DIG. 1

[58] Field of Search ..... 355/245, 260, 205, 206, 355/207; 118/653; 222/DIG. 1

[56] References Cited

U.S. PATENT DOCUMENTS 4,523,834 6/1985 Pelda ..... 222/DIG. 1
4,688,926 8/1987 Manno ..... 222/DIG. 1
4,732,277 3/1988 Smith ..... 222/DIG. 1
4,778,086 10/1988 Shibata et al. ..... 222/DIG. 1
4,870,463 9/1989 Miyoshi et al. ..... 222/DIG. 1

*Primary Examiner*—R. L. Moses
*Attorney, Agent, or Firm*—Oblon, Spivak, McClelland, Maier & Neustadt

[57] ABSTRACT

A structure of a toner cartridge removably mounted on a developing unit of an image forming apparatus. Once a toner end mode is set due to the exhaustion of toner which is accommodated in the toner cartridge, it is prevented from being reset unless the empty cartridge is replaced with a full toner cartridge. The toner cartridge has a member capable of resetting a toner and mode only when the cartridge is loaded in a cartridge container for the first time. This member is sensed by a sensor when the toner cartridge is inserted in the cartridge container. After the toner cartridge is inserted in the cartridge container the member along with a seal are removed from the toner. This member is sensed by a sensor when the toner cartridge is inserted in the cartridge container. After the toner cartridge is inserted in the cartridge container the member along with a seal are removed from the toner cartridge.

10 Claims, 3 Drawing Sheets

TONER CARTRIDGE FOR AN IMAGE FORMING APPARATUS

This is a division of application Ser. No. 07/363,766, filed on Jun. 9, 1989 now U.S. Pat. No. 4,963,938 .

BACKGROUND OF THE INVENTION

The present invention relates to an image forming apparatus of the type configuring a toner, or developer, into a magnet brush for developing an electrostatic latent image and, more particularly, to the structure of a toner cartridge which contains the toner and is removably mounted on the image forming apparatus.

In an electrophotographic copier, facsimile apparatus, printer or similar image forming apparatus of the type described, a developing unit generally uses a two-component developer which is made up of carrier particles and toner particles which are deposited on the carrier particles. The apparatus includes a developing sleeve in which magnets are accommodated to cause the developer to form a magnet brush on the sleeve. The magnet brush is brought into contact with a latent image electrostatically formed on a photoconductive element, or image carrier, so that only the toner of the developer is deposited on the latent image to form a toner image. Since the toner concentration or density in the developer sequentially decreases due to the repetitive copying operation, it is necessary to supply a fresh toner when the decrease in toner density is sensed. Usually, a toner is contained in a toner cartridge which is mounted on the developing unit of the image forming apparatus. Hence, when the toner cartridge runs out of toner, it has to be replaced with a new toner cartridge which is filled with a fresh toner.

It is a common practice to set the toner cartridge in a cartridge container which is provided in the developing unit and, when the density of a toner image formed on the photoconductive element is determined to be low, to cause the toner to be supplied through an opening of the cartridge into the casing of the developing unit. When the toner concentration in the cartridge decreases beyond a predetermined threshold as a result of repeated tone supply, a toner end state is sensed and displayed or otherwise indicated to alert the operator to such an occurrence. In practice, however, even after the operator has been warned of the toner end state, some toner is still available in the developing unit so that the development may be repeated for a while, although the image density will be somewhat lowered. Therefore, it sometimes occurs that the operator continuously uses the copier in spite of the toner end warning by resetting a toner end mode intentionally without replacing the toner cartridge, at the sacrifice of image density. This brings about a problem that, apart from the decrease in image density, silicon films provided on the carrier particles are destroyed due to the exhaustion of toner to lower the insulation resistance, resulting in the deposition of the carrier particles on the photoconductive element.

SUMMARY OF THE INVENTION

It is an object of the present invention to provide a toner cartridge for an image forming apparatus which enhances the protection of a photoconductive element or similar image carrier while insuring stable image quality.

It is another object of the present invention to provide a toner cartridge for an image forming apparatus which, when a toner cartridge runs out of toner, causes it to be surely replaced with another by eliminating erroneous manipulations.

It is another object of the present invention to provide a generally improved toner cartridge for an image forming apparatus.

A toner cartridge for a developing unit having a cartridge container for accommodating the toner cartridge, and a cartridge sensor associated with the cartridge container for sensing that the toner cartridge has been set in the cartridge container of the present invention comprises a member for actuating the cartridge sensor when the toner cartridge is set in the cartridge container, and means for preventing, after the member has actuated the cartridge sensor, the member from actuating the cartridge again.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
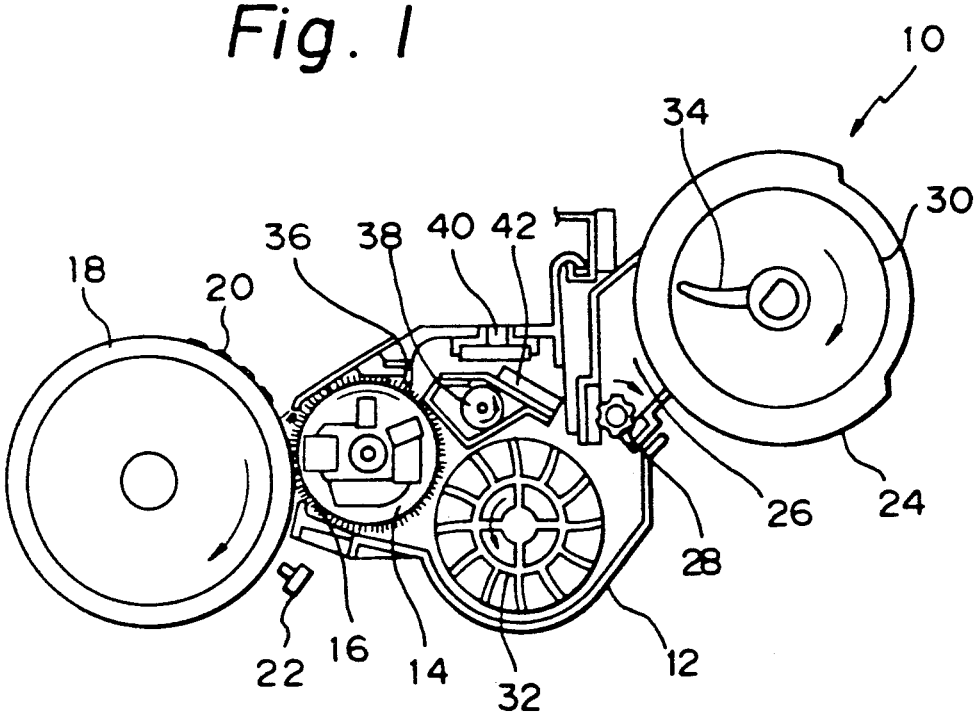
FIG. 1 is a sectional side elevation of a developing unit of an image forming apparatus to which a toner cartridge of the present invention is applicable.

Referring to FIG. 1 of the drawings, a developing unit of an electrophotographic copier to which the present invention is applicable is shown and generally designated by the reference numeral 10. The developing unit 10 has a casing 12 in which a developing roller 14 is disposed. As the developing roller 14 is rotated, a magnet brush 16 formed on the roller 14 and constituted by a developer is brought into contact with a photoconductive drum 18 on which a latent image 20 has been electrostatically formed. As a result, toner particles existing in the magnet brush 16 are deposited on the latent image 20. A photosensor 22 senses the density of the toner being deposited on the latent image 20. When the toner density is determined to be low on the basis of the output of the photosensor 22, a supply roller 28 located at the outlet of a hopper 26 which forms a part of a cartridge container 24 is rotated. Consequently, a toner is supplied from a toner cartridge 30 which is loaded in the cartridge container 24 to an agitating roller 32 that is disposed in the casing 12. At this instant, an agitator 34 accommodated in the toner cartridge 30 is rotated also. As the toner cartridge 30 runs out of toner due to the repetitive toner supply, a toner end state is sensed and displayed or otherwise indicated to warn the operator of such an occurrence. In the figure, the reference numerals 36, 38, 40 and 42 designate a doctor blade, a transport screw, a filter, and an agitating separator, respectively.

Even after the toner end state has been sensed to set up a toner end mode, the developing unit 10 can be continuously operated for a while without the image density being critically lowered, if the toner end mode is reset, as discussed earlier. Specifically, the operator can intentionally reset the toner end mode by removing the empty toner cartridge 30 from the cartridge container 24 and then inserting it again into the cartridge container 24. This brings about the deposition of carrier particles on the drum 18, as previously stated.

Figure 2:
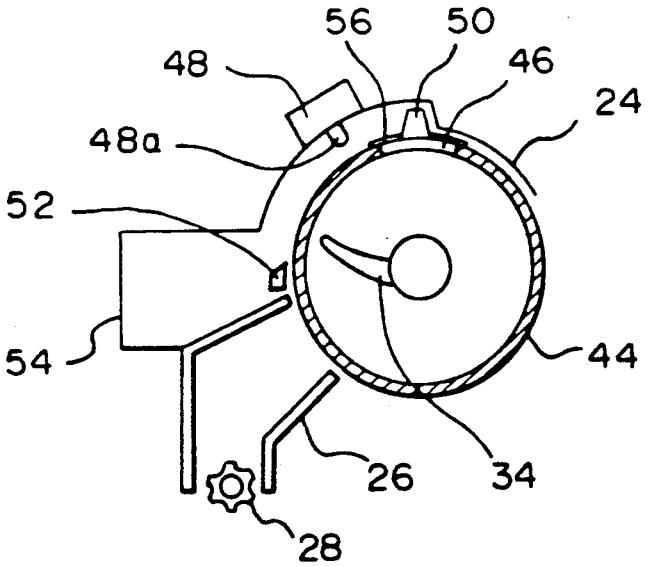
FIG. 2 is a section showing a toner cartridge embodying the present invention.

Referring to FIG. 2, a toner cartridge 44 embodying the present invention is shown. Assume that the toner cartridge 44 is used with a developing unit which has the same construction as the developing unit 10 of FIG. 1. As shown, the toner cartridge 44 has a wall which is provided with an opening 46. A lug 50 extends radially outward from an end of the wall of the toner cartridge 44, while a switch 48 having a terminal 48*a* is mounted on the cartridge container 24. When the toner cartridge 44 is inserted into the cartridge container 24 with its opening 46 facing upward and then rotated counterclockwise as viewed in FIG. 2, the lug 50 of the cartridge 44 presses the terminal 48*a* of the switch 48. The loading of the toner cartridge 44 is therefore sensed in response to the output of the switch 48. A cutter 52 is situated above the hopper 26 of the cartridge container 24, i.e., upstream of the hopper 26 with respect to the counterclockwise rotation of the toner cartridge 44. While the toner cartridge 44 is rotated counterclockwise, the cutter 52 cuts off the lug 50 of the cartridge 44 before the lug 50 reaches the hopper 26. The lug 50 removed from the toner cartridge 44 is collected in a collecting portion 54 which is formed in a predetermined position of the cartridge 44, as illustrated. The reference numeral 56 designates a seal which is adhered to the toner cartridge 44 to close the opening 46.

Figure 3:
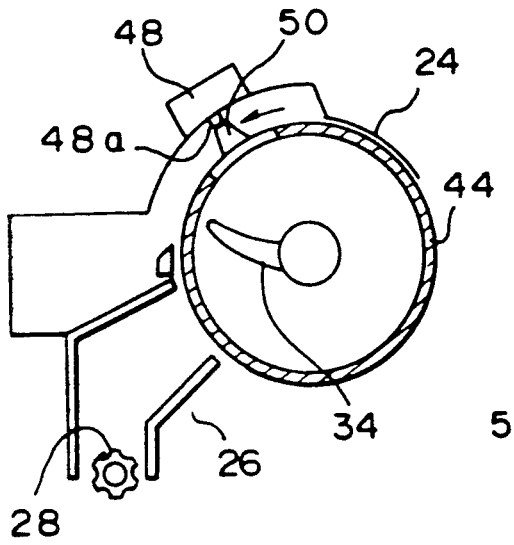
FIGS. 3 to 5 are sections showing the toner cartridge of FIG. 2 in different positions.
Figure 4:
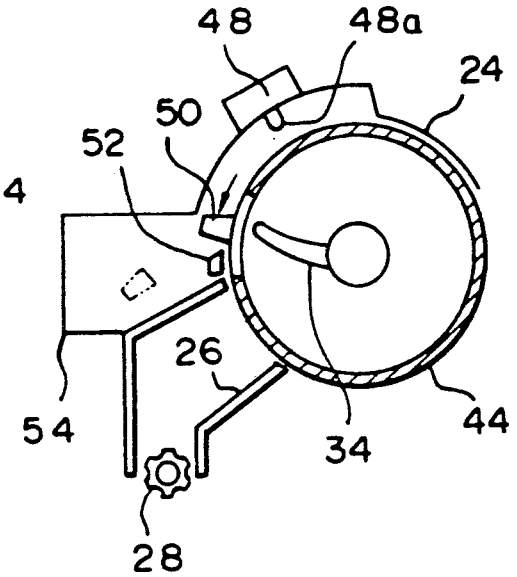
Figure 5:
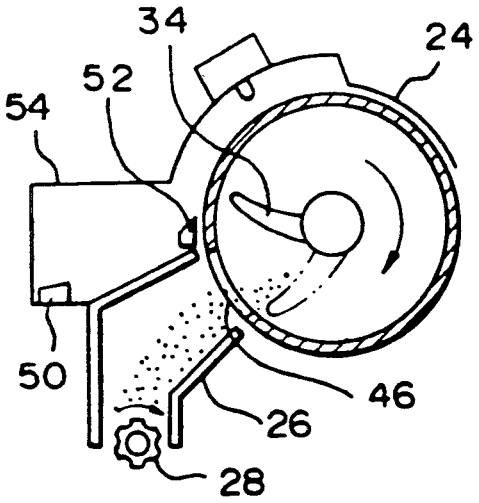

The toner cartridge 44 is inserted into the cartridge container 24 with its opening 46 facing upward, as shown in FIG. 2. Simultaneously, the seal 56 is removed from the toner cartridge 44 to uncover the opening 46. After the toner cartridge 44 has been fully received in the cartridge container 24, it is rotated counterclockwise, as shown in FIG. 3. In the position of FIG. 3, the lug 50 of the toner cartridge 44 presses the terminal 48*c* of the switch 48. The resulting output of the switch 48 shows that the toner cartridge 44 has been loaded in the cartridge container 24. As the toner cartridge 44 is further rotated counterclockwise, the lug 50 having moved away from the switch 48 is cut off by the cutter 56, as shown in FIG. 4. Finally, the opening 46 of the toner cartridge 44 is brought into register with the inlet of the hopper 26, as shown in FIG. 5. The lug 50 removed from the toner cartridge 44 is collected in the collecting portion 54. It is to be noted that the manual operation associated with the toner cartridge 44 itself is the same as the conventional operation. In the condition shown in FIG. 5, the toner is fed from the toner cartridge 44 into the hopper 26 through the opening 46 while being agitated by the agitator 34 which is accommodated in the cartridge 44. As the supply roller 28 situated at the outlet of the hopper 26 is rotated, the toner is supplied thereby to the agitating roller 32 which is located in the casing 12.

The toner cartridge 44 set in the cartridge container 24 has lost the lug 50, as stated above. Assume that the toner cartridge 44 has run out of toner resulting in a toner end mode being set. In this condition, when the empty toner cartridge 44 is removed from the cartridge container 24 and then inserted again, it cannot press the terminal 48*a* of the switch 48 any longer and, therefore, the toner end mode cannot be reset. This inhibits further use of the copier and thereby prevents the toner in the developer from being exhausted. The exhaustion of toner would cause carrier particles to deposit on the drum 18 to thereby lower the image quality.

Figure 6:
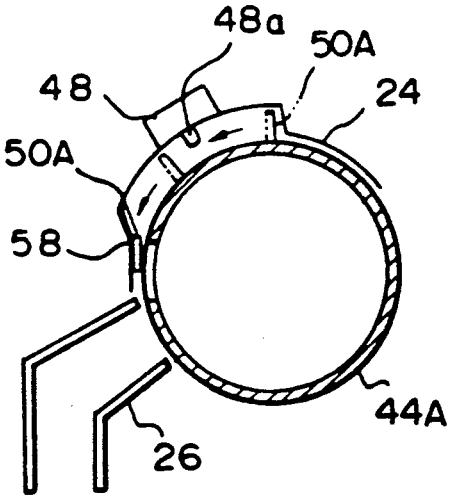
FIG. 6 is a section showing a modification to the toner cartridge of FIG. 2.

Referring to FIG. 6, a modification to the above-described embodiment is shown. In the modification, a toner cartridge 44A has a unremovable lug 50A made of soft resin, in place of the removable lug 50 of the toner cartridge 44. In FIG. 6, the cartridge container 24 is protruded inward in the vicinity of the inlet of the hopper 26 to form a stepped portion 58. In this configuration, the stepped portion 58 forcibly brings down the lug 50A and thereby permanently deforms it while the toner cartridge 44A is rotated. While the toner cartridge 44A achieves the same advantages as stated in relation to the toner cartridge 44, it has another advantage that the collecting portion 54 is not necessary because the lug 50A is not cut off.

As stated above, in the illustrative embodiment and its modification, once the toner cartridge 44 or 44A is set in the cartridge container 24, the lug 50 or 50A is removed or deformed and cannot engage the switch 48 any longer. Hence, even if the empty toner cartridge 44 or 44A is removed from the cartridge container 24 and inserted again, it cannot reset the toner end mode. This protects the drum 18 which is an expensive element against the deposition of carrier particles due to the exhaustion of toner, thereby insuring stable image quality at all times.

Referring to FIGS. 7 to 10, an alternative embodiment of the toner cartridge in accordance with the present invention is shown. The toner cartridge, generally 44B, is also used with a developing unit having the same construction as the developing unit 10 shown in FIG. 1. As shown, the toner cartridge 44B has a seal 64 which covers an opening 62 formed though a cylindrical body 60 of the cartridge 44B. In this particular embodiment, a magnet or similar member to be sensed is fitted in a predetermined position of the surface of the seal 64, while a sensor 66 is mounted on an upper portion of the cartridge container 24. In this construction, when the seal 64 is removed from the opening 62 of the cartridge body 60, the member 68 is removed together with the seal 64.

Figure 7:
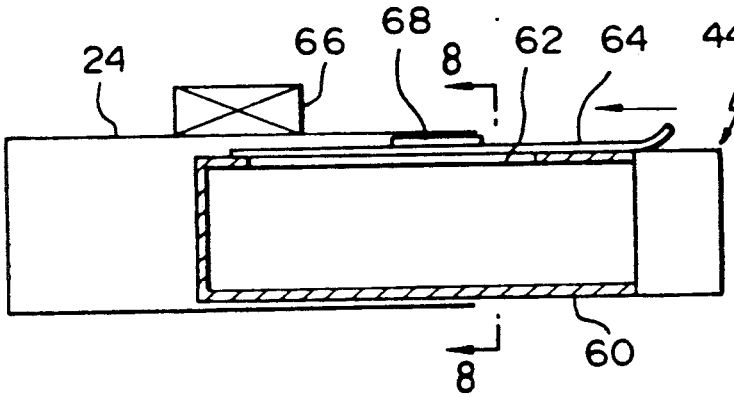
FIG. 7 is a sectional elevation of another embodiment of the present invention.
Figure 8:
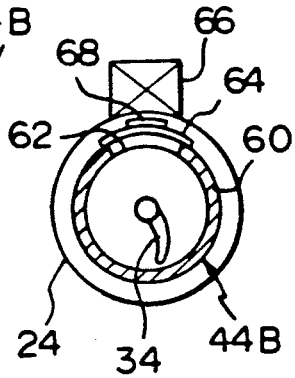
FIG. 8 is a view as seen in a direction VIII—VIII of FIG. 7.
Figure 9:
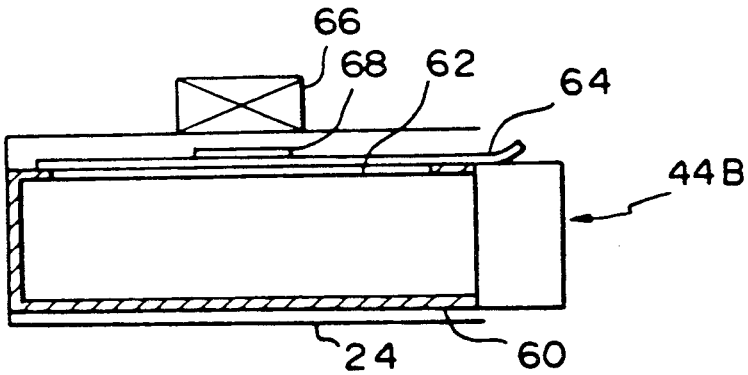
FIGS. 9 and 10 are sectional elevations showing the toner cartridge of FIG. 7 in different conditions.

As shown in FIGS. 7 and 8, the toner cartridge 44B is inserted into the cartridge container 24 with its opening 62 facing upward. As the member 68 fitted on the seal 64 aligns with the sensor 668 the latter senses the former so that the loading of the toner cartridge 44B is recognized.

Figure 10:
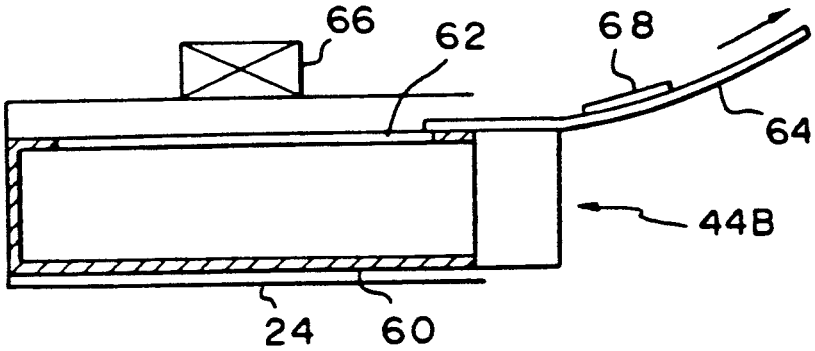

After the toner cartridge 44 has been fully inserted in the cartridge container 24, the seal 68 is removed from the cartridge body 60 to uncover the opening 62 while carrying the member 68 therewith, as shown in FIG. 10. Then, the cartridge body 60 is rotated until the opening 62 thereof reaches the hopper 26 (FIG. 1). In this condition, a toner accommodated in the cartridge body 60 is agitated by the agitator 34 while being fed out into the hopper 26 through the opening 62. As the supply roller 28 situated at the outlet of the hopper 26 is rotated, the toner is supplied to the agitating roller 32 which is located in the casing 12.

The member 68 to be sensed by the sensor 66 is removed together with the seal 64, as stated above. Hence, even when the toner cartridge 44B having run out of toner is removed from the cartridge container 24 and then inserted again, a toner end mode set is prevented from being reset and, hence, the copier is inhibited from being continuously used. This is successful in eliminating the deposition of carrier particles on the drum 18 due to the consumption of toner and, therefore, in insuring stable image quality at all times.

While the embodiments of the present invention has been shown and described in relation to a developing unit of a copier, they are of course applicable to any other kind of image forming apparatus such as a printer.

Various modifications will become possible for those skilled in the art after receiving the teachings of the present disclosure without departing from the scope thereof.

What is claimed is:

1. A cartridge comprising:

a removable member indirectly disposed on said cartridge; and a member to be sensed by a sensor, said sensor being mounted on an apparatus body, said member to be sensed being mounted on said removable member such that said sensor senses said member to be sensed when said cartridge is set in said apparatus and said member to be sensed is positioned close to but does not contact said sensor;

wherein said removable member and said member to be sensed mounted thereon are removed from said cartridge after said cartridge has been set in said apparatus.

2. The cartridge as claimed in claim 1, wherein said member is made of a magnetic member to be sensed.

3. The cartridge as claimed in claim 2, wherein said sensor is constructed to sense magnetism of said magnetic member.

4. The cartridge as claimed in claim 1, wherein said apparatus is a developing unit and said cartridge is a toner cartridge for use with said developing unit which comprises a cylindrical body containing a toner therein, an opening formed through said cylindrical opening and said removable member is a seal which covers said opening.

5. The cartridge as claimed in claim 4, wherein said member to be sensed is provided on a surface of said seal and said removable member is indirectly disposed on said cartridge through said seal.

6. The cartridge as claimed in claim 5, wherein said member to be sensed is removed together with said seal when said seal is removed from said opening after said toner cartridge has been set in said developing unit.

7. The cartridge as claimed in claim 1, wherein said developing unit is provided with a cartridge container for accommodating said toner cartridge.

8. A toner cartridge comprising:

a body storing a toner therein;

an opening for discharging the toner stored in said body;

a seal member closing said opening; and a member to be sensed located in such a position that a sensor mounted on an apparatus body senses said member when said toner cartridge is mounted on said apparatus body with said seal member closing said opening or does not sense said member when said toner cartridge is mounted on said apparatus body with said seal having been removed from said opening.

9. A toner cartridge as claimed in claim 8, wherein said member to be sensed is sensed by said sensor of said apparatus body without contacting said sensor.

10. A toner cartridge as claimed in claim 8, wherein said member to be sensed is provided on said seal member.

* * * * *